US006109610A

United States Patent [19]

Cherry et al.

[11] Patent Number: 6,109,610

[45] **Date of Patent: *Aug. 29, 2000**

[54] GAME OF CHANCE

[75] Inventors: Eric Cherry, Highland Beach; Jill DeChello, Cooper City, both of Fla.

[73] Assignee: Horse Sense Corporation, Delray Beach, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 08/707,710

[22] Filed: Sep. 3, 1996

[51] Int. Cl.[7] ..... A63F 3/00

[52] U.S. Cl. ..... 273/269; 273/274

[58] Field of Search ..... 273/269, 264, 273/271, 287, 274, 284

[56] References Cited

U.S. PATENT DOCUMENTS

| | | | |
|---|---|---|---|
| 1,655,380 | 1/1928 | Parker . | |
| 3,618,952 | 11/1971 | Tallarida | 273/269 |
| 4,092,029 | 5/1978 | Jones | 273/271 |
| 4,732,393 | 3/1988 | Rita | 273/269 |
| 4,747,600 | 5/1988 | Richardson | 273/269 |
| 4,856,788 | 8/1989 | Fischel | 273/256 |
| 4,909,516 | 3/1990 | Kolinsky | 273/237 |
| 5,022,653 | 6/1991 | Suttle et al. | 273/85 CP |
| 5,288,077 | 2/1994 | Jones | 273/292 |
| 5,374,067 | 12/1994 | Jones | 273/292 |
| 5,377,973 | 1/1995 | Jones et al. | 273/85 CP |
| 5,380,012 | 1/1995 | Jones et al. | 273/292 |
| 5,382,025 | 1/1995 | Sklansky et al. | 273/292 |
| 5,536,016 | 7/1996 | Thompson | 273/269 |
| 5,700,009 | 12/1997 | Meoni | 273/269 |

FOREIGN PATENT DOCUMENTS 2 182 476 A 5/1987 United Kingdom .

OTHER PUBLICATIONS

Seminole Indian Bingo Rules for Lighting Bingo (one page).

*Primary Examiner*—William M. Pierce
*Attorney, Agent, or Firm*—Fish & Richardson P.C.

[57] ABSTRACT

A method of playing a game of chance, and the game of chance, include providing a player with one, two or three game boards at the selection of the player. Each board has a linear arrangement of three spaces, and each space is marked with a game number chosen from a set of game numbers. The boards are aligned adjacent to each other if the player is provided with three boards to create a 3×3 array of marked spaces. A plurality of numbers is randomly selected one at a time from a collection of numbers. Each space is covered with a token if the game number marked on the space matches the number selected from the collection of numbers. The player wins the game if when one or two boards are played the player covers all the spaces on either board or when three boards are played the player covers any three linearly consecutive spaces of the 3×3 array. The game may be any n-number game of chance played with boards having linear arrangements of n marked spaces. The game may also be implemented as an electronic game of chance.

22 Claims, 6 Drawing Sheets

GAME OF CHANCE

BACKGROUND OF THE INVENTION

This invention relates to a game of chance, and in particular, a game played on a board marked with numbers to be matched to a set of drawn numbers.

In a traditional bingo game, players each have a game board with 24 numbers arranged in a 5×5 array of spaces with a center "free" space. The numbers 1 through 75 are grouped with the letters B, I, N, G and O such that the numbers 1 through 15 are in the "B" group, the numbers 16 through 30 are in the "I" group, etc. A game officiant randomly selects numbers from the set of numbers 1 through 75 and announces them to the players. The players cover the spaces on their game boards corresponding to the called numbers with tokens, e.g., chips. A player wins the game, e.g., when he or she has covered five spaces in a row, either horizontally, vertically or diagonally.

Bingo is typically played as a game of chance in a betting environment. Players may place wagers, e.g., by purchasing game boards for a particular game or series of games. The payoff to the winner of a bingo game may be determined, e.g., as a fraction of the total amount of money paid by all players to purchase their game boards.

Although bingo is a simple game to play, it is considered a relatively slow game, since many numbers from the set of numbers 1 through 75 must be chosen before a winner is determined.

SUMMARY OF THE INVENTION

It is an object of the present invention to provide a simple, high-paced game of chance to be played in casinos and other gaming establishments.

In general, in one aspect, the invention features a method of playing a game of chance in which a player is provided with one, two or three game boards at the selection of the player. Each board has a linear arrangement of three spaces, and each space is marked with a game number chosen from a set of game numbers. The boards are aligned adjacent to each other if the player is provided with three boards to create a 3×3 array of marked spaces. A plurality of numbers are randomly selected one at a time from a collection of numbers. Each space is covered with a token if the game number marked on the space matches the number selected from the collection of numbers. The player wins the game if when one or two boards are played the player covers all the spaces on either board or when three boards are played the player covers any three linearly consecutive spaces of the 3×3 array.

Implementations of the invention may also include one or more of the following features. The player may purchase the boards and the tokens to be played during the game.

The collection of numbers may include a free number and the numbers 1 through 69.

The player may pay an ante to participate in the game.

The numbers may be randomly selected by an officiant. The officiant may be a computerized game controlling device including a random number generator.

Play of the game may be stopped when a winning status is indicated.

Each player may place 3 tokens for each board in a designated area at the beginning of each game. The spaces may be covered with tokens from the designated area. The tokens remaining in the designated areas of all non-winning players may be given to one or more winning players when play of the game has ended. The payout provided to a winning player may be based on odds.

The game may be an electronic game of chance.

In general, in another aspect, the invention features a method of playing an n-number game of chance, n being an integer greater than or equal to 2, in which a player is provided with a number of game boards at the selection of the player, the number being any number from 1 to n inclusive. Each board has a linear arrangement of n spaces, and each space is marked with a game number chosen from a set of game numbers. The boards are aligned adjacent to each other if the player is provided with n boards to create an n×n array of marked spaces. A plurality of numbers is randomly selected one at a time from a collection of numbers. Each space is covered with a token if the game number marked on the space matches the number selected from the collection of numbers. The player wins the game if when less than n boards are played the player covers all the spaces on any one board or when n boards are played the player covers any n linearly consecutive spaces of the n×n array.

Implementations of the invention may also include one or more of the following features. The number n may be 3 or 4.

In general, in another aspect, the invention features a game of chance to be played by a player having a plurality of game boards. Each board has a linear arrangement of three spaces, and each space is marked with a game number chosen from a set of game numbers. The player selects one, two or three boards, and the player aligns the three boards if selected adjacent to each other to create a 3×3 array of marked spaces. A plurality of tokens are used to cover the spaces. A collection of game pieces marked with numbers is randomly selected one at a time, and the player covers the marked spaces matching the numbers selected with tokens. The player wins the game if when or two boards are played the player covers all the spaces on either board or when three boards are played the player covers any three linearly consecutive spaces of the 3×3 array.

Implementations of the invention may also include one or more of the following features. The game pieces may be balls. The game pieces may be randomly selected by an officiant. The officiant may be a computerized game controlling device including a random number generator.

In general, in another aspect, the invention features an electronic gaming device for playing a game of chance by a player having a screen displaying one, two or three game boards at the selection of the player. Each board has a linear arrangement of three spaces, and each space is marked with a game number chosen from a set of game numbers. The three boards if selected are arranged as a 3×3 array of marked spaces. A processor randomly selects numbers one at a time and causes the spaces of the player's boards marked with the numbers selected to be covered with a plurality of tokens. The player wins the game if when or two boards are played the player covers all the spaces on either board or when three boards are played the player covers any three linearly consecutive spaces of the 3×3 array.

The game of the present invention has the advantage of allowing a large number of players to participate in a high-paced game that is simple to play and provides rapid payouts to winners.

Other features and advantages of the invention will become apparent from the following detailed description, and from the claims.

DESCRIPTION OF THE PREFERRED EMBODIMENTS

The game of the present invention is an n-number game of chance, where n is an integer greater than or equal to 2. For example, n may be 3 or 4.

Figure 1:
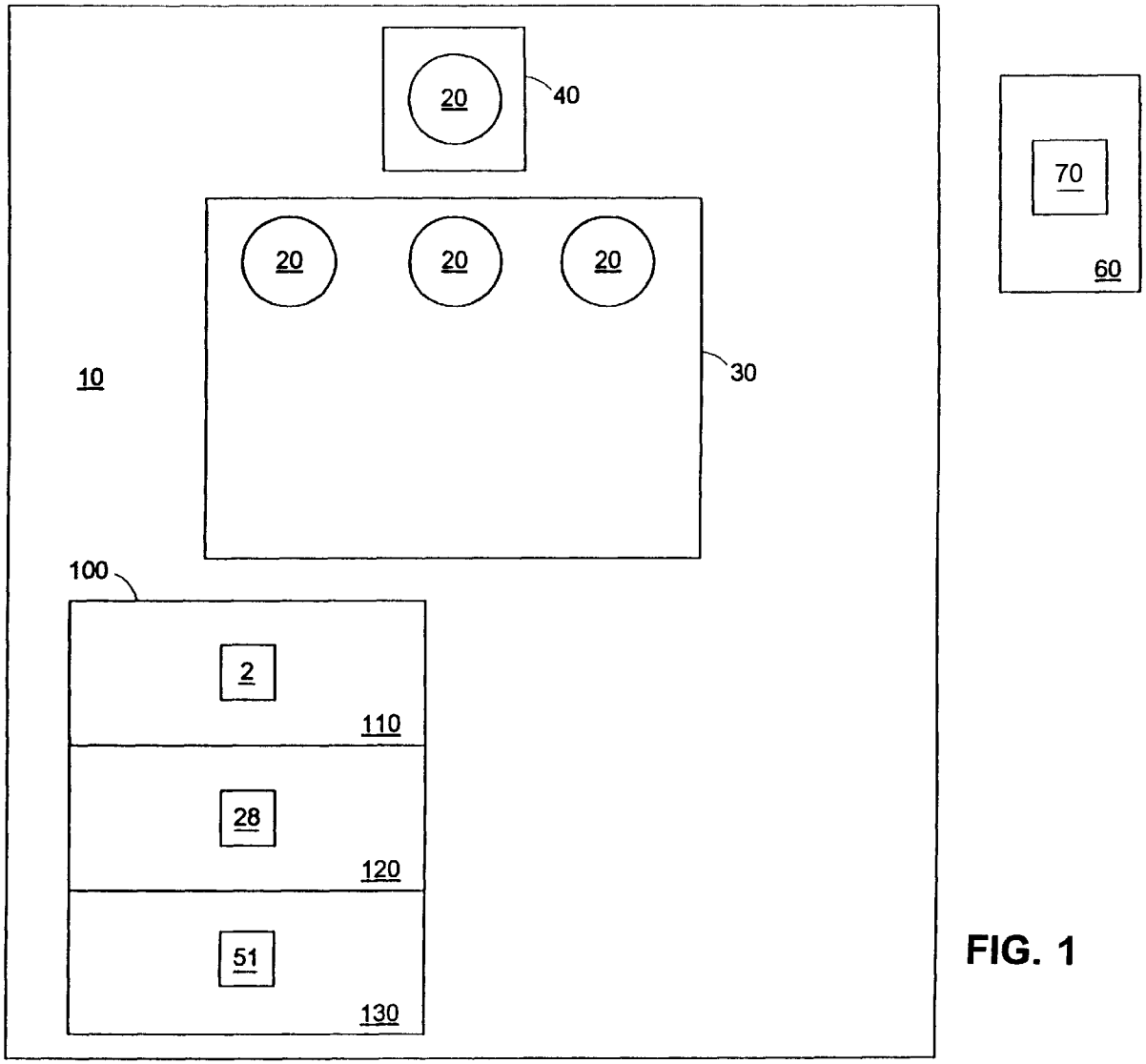
FIG. 1 shows the game of the present invention as played with one game board.

As shown in FIG. 1, the game is played with a game board 100 that contains separate spaces organized in a consecutive linear arrangement. For example, game board 100 has three distinct spaces 110, 120, 130 in a vertical line.

Each space 110, 120, 130 on game board 100 is shaped substantially like a square and is labeled with a game number selected from a set of numbers. Each of the three spaces 110, 120, 130 is labeled with a number selected from a different subset of the set of numbers. If the set of numbers is 1 through 69, space 110 may be labeled with a number chosen from the subset of numbers 1 through 23, space 120 may be labeled with a number chosen from the subset of numbers 24 through 46, and space 130 may be labeled with a number chosen from the subset of numbers 47 through 69. For example, as shown in FIG. 1, space 110 is labeled with the number "2", space 120 is labeled with the number "28", and space 130 is labeled with the number "51". No two game boards used in a particular game are identical, although any one number may be used on several different boards.

The game is played by at least two players, and preferably by a large number of players. Each player plays one (FIG. 1), two (spaces 210, 220 and 230 in FIG. 2) or three (spaces 310, 320 and 330 in FIG. 3) boards at a time. No two game boards distributed to the players are identical. Typically, the player purchases each game board for a fixed price, e.g., $3.00.

Figure 2:
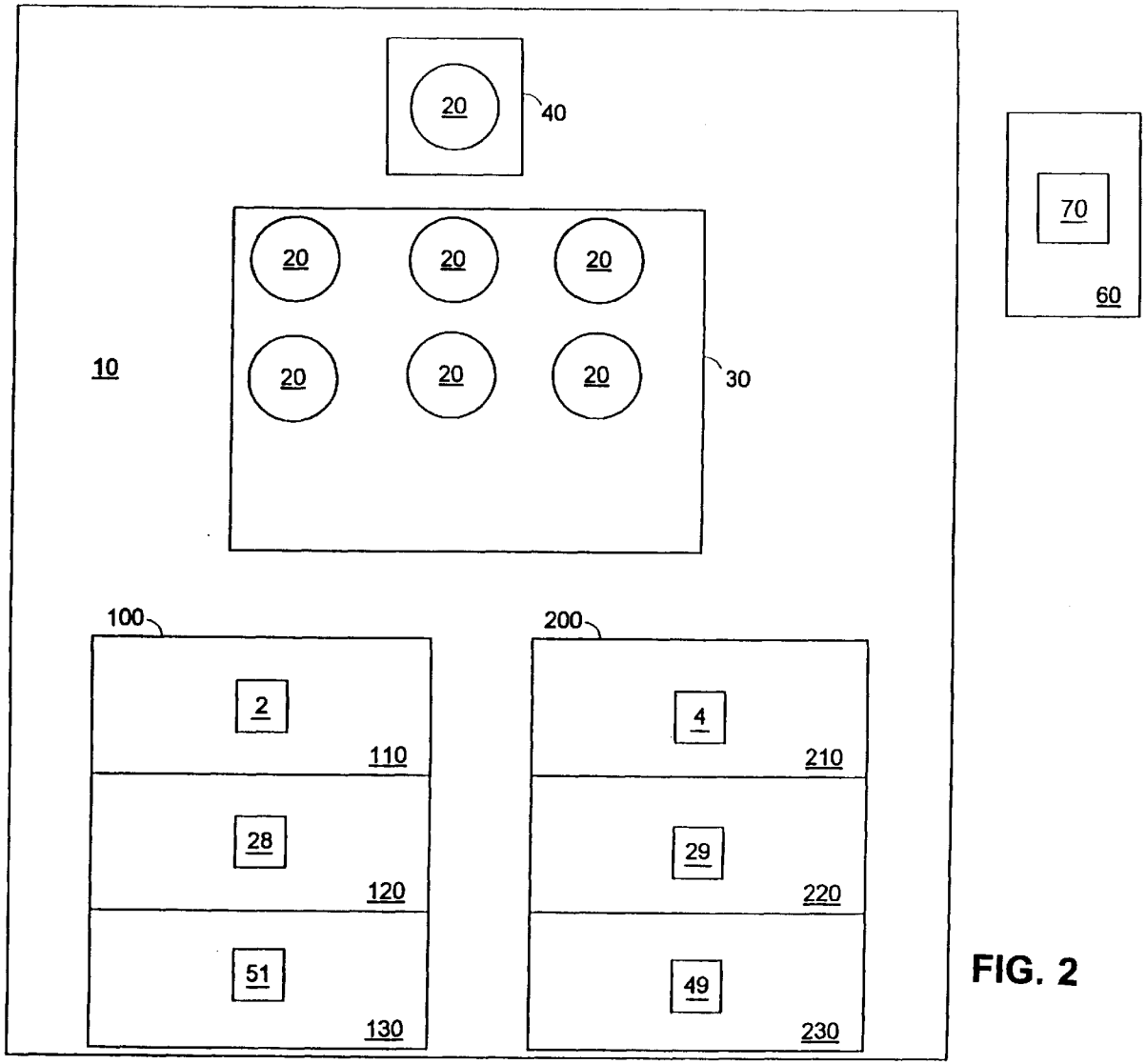
FIG. 2 shows the game of the present invention as played with two game boards.
Figure 3:
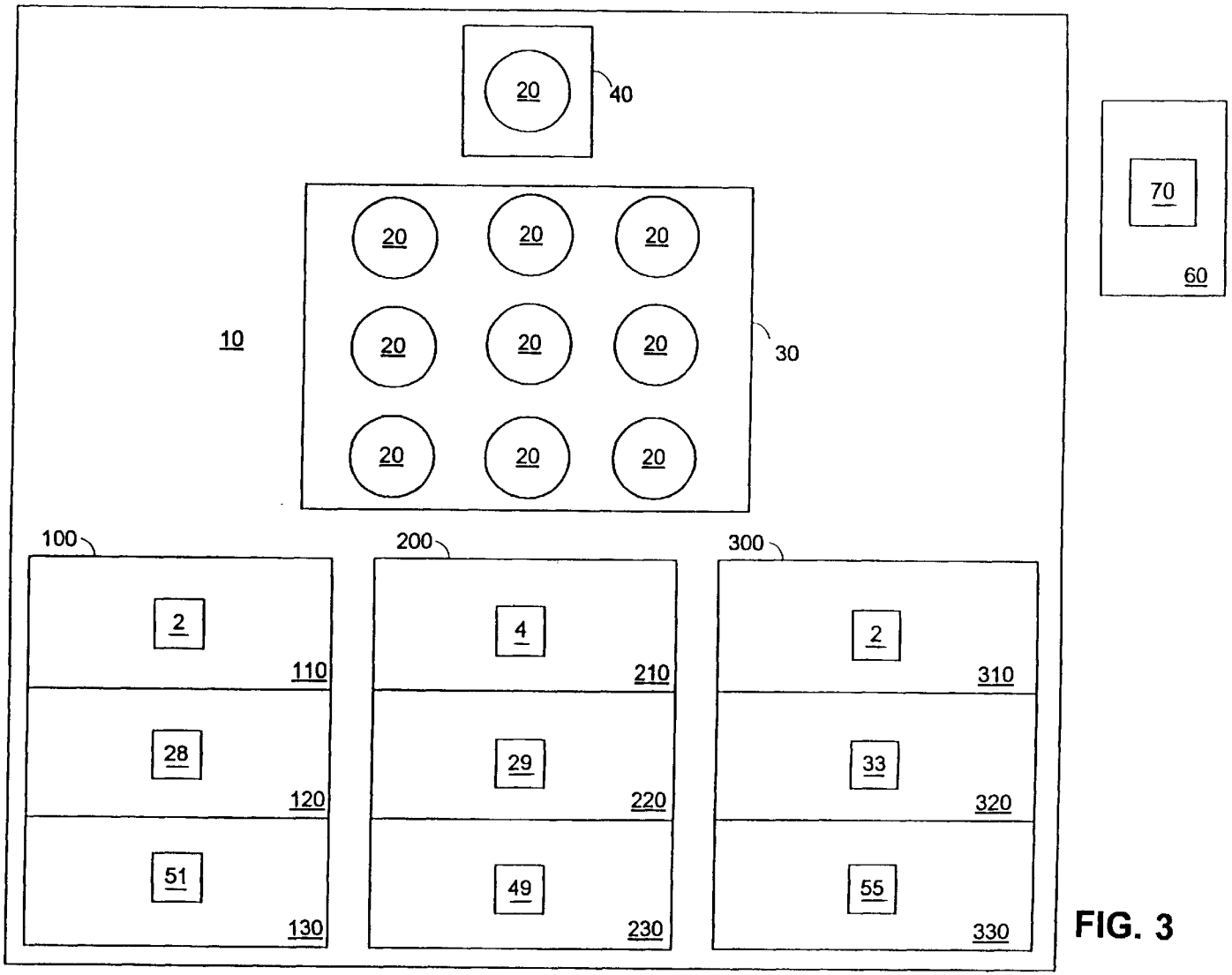
FIG. 3 shows the game of the present invention as played with three game boards.

As shown in FIGS. 1, 2 and 3, each player places his or her game boards on a playing surface 10 accessible to the player. If the player is playing three game boards 100, 200, 300, the player sets up the boards on playing surface 10 in any order to form a 3×3 array or grid, as shown in FIG. 3. If the player is playing one game board 100 or two game boards 100 and 200, the boards may be set up in any manner, as shown in FIGS. 1 and 2, respectively.

The players also purchase betting chips or tokens 20 to play the game. Each chip 20 has a predetermined value, e.g., $0.25. At the start of each game, each player sets out three chips per game board in a designated playing chip area 30 in front of his or her game boards. Players may not hold chips in their hands while a game is being played. In one embodiment, the player places one "ante" chip in a designated ante area 40 to be collected by the "house" at the start of the game. In an alternative embodiment, there is no ante chip collected by the house.

A collection of game pieces, e.g., balls containing numbers corresponding to spaces marked on the game boards, is stored in a container. There may also be a "free" number game piece. In the example described above, the number collection includes a set of game pieces numbered from 1 through 69, and may also include a distinctly colored game piece that represents the free number.

A game officiant 60 randomly chooses game pieces one at a time from the collection of game pieces. Officiant 60 is often referred to as the "house", and may be an electronic or computerized game controlling device. In the case of a computerized game, the numbers may be chosen by a random number generator 70.

The officiant 60 calls out the number marked on each game piece as it is selected so that all of the game players can hear it. If the officiant chooses the free number, the officiant indicates the selection with a statement such as "Lightning Number". During play of a particular game, chosen game pieces are not returned to the game piece collection, but rather are set aside until the next game is played, at which time the chosen game pieces are returned to the collection.

As numbers are chosen, the players cover each space on their game boards 100, 200, 300 corresponding to the called number with one of the chips they had placed in the playing chip area 30. For example, if the officiant 60 selects and calls the number "2", the players cover all spaces marked "2" on their game boards. If the "free" number is chosen, all players may cover one space of their own choosing on their boards. Generally, once the free number has been selected by the officiant and the players have chosen which space to cover on their boards, the players cannot change their choices during the course of play of the game.

Figure 4:
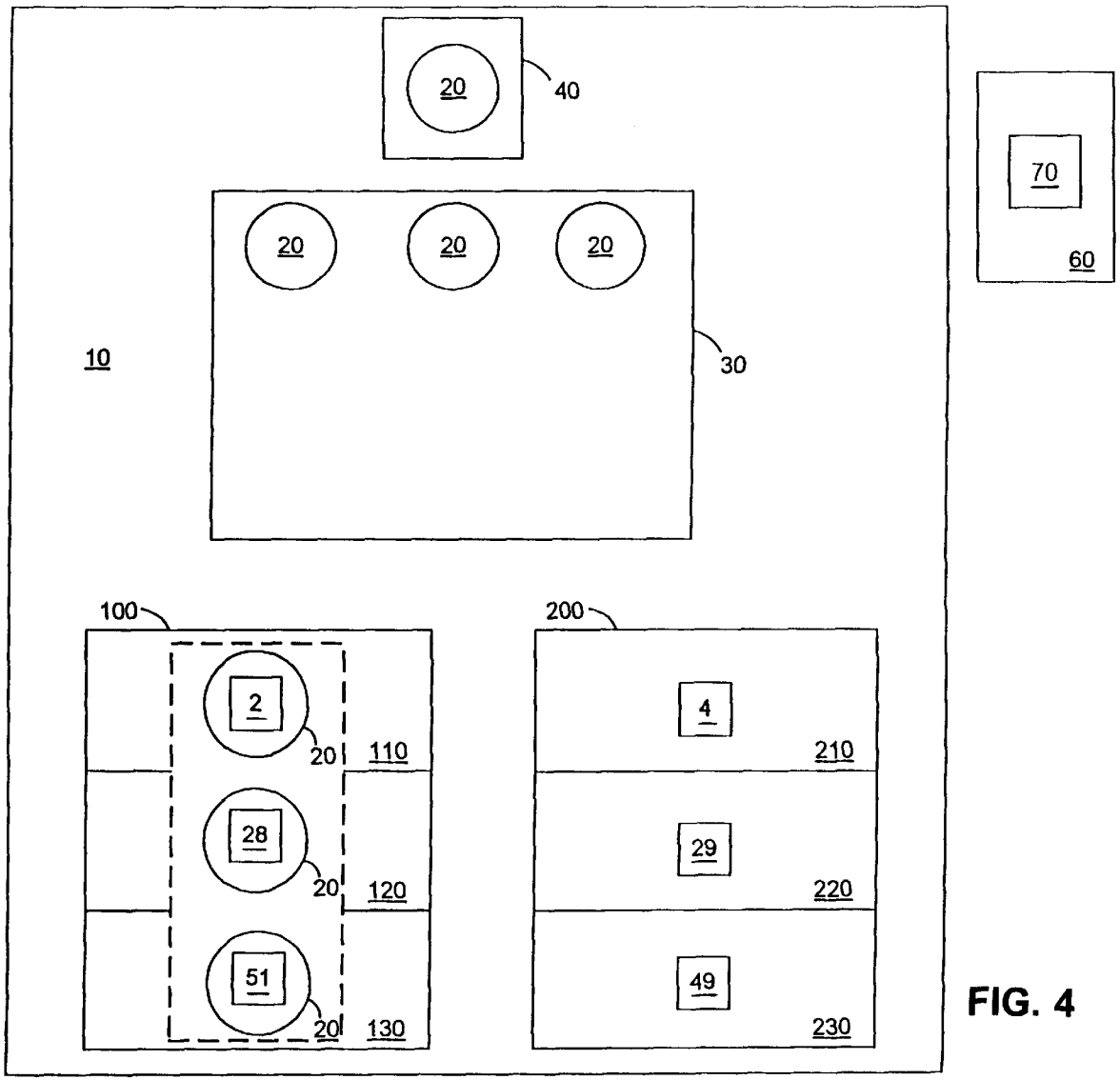
FIG. 4 shows a winning combination of the game of FIG. 2.
Figure 5:
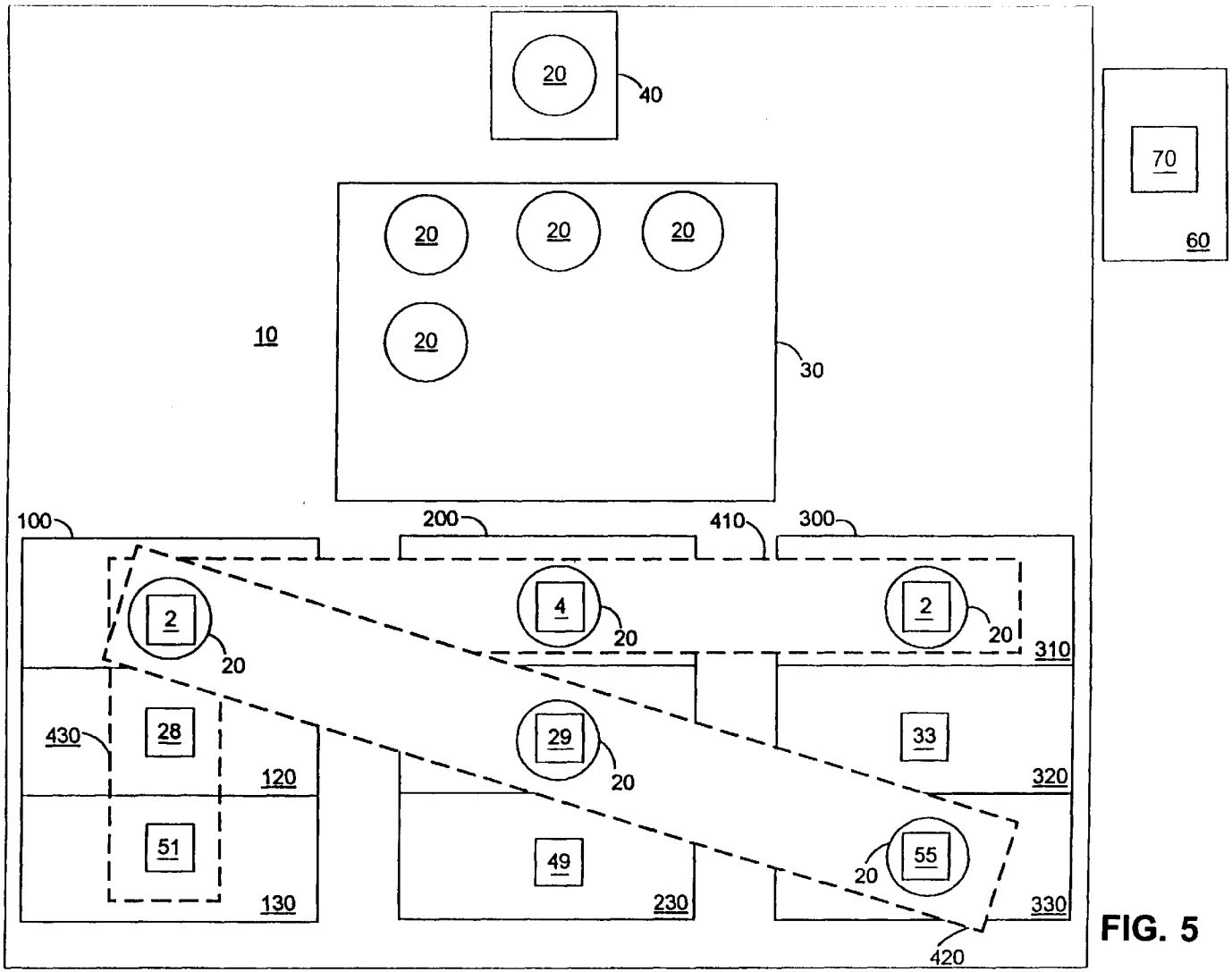
FIG. 5 shows winning combinations of the game of FIG. 3.
Figure 6:
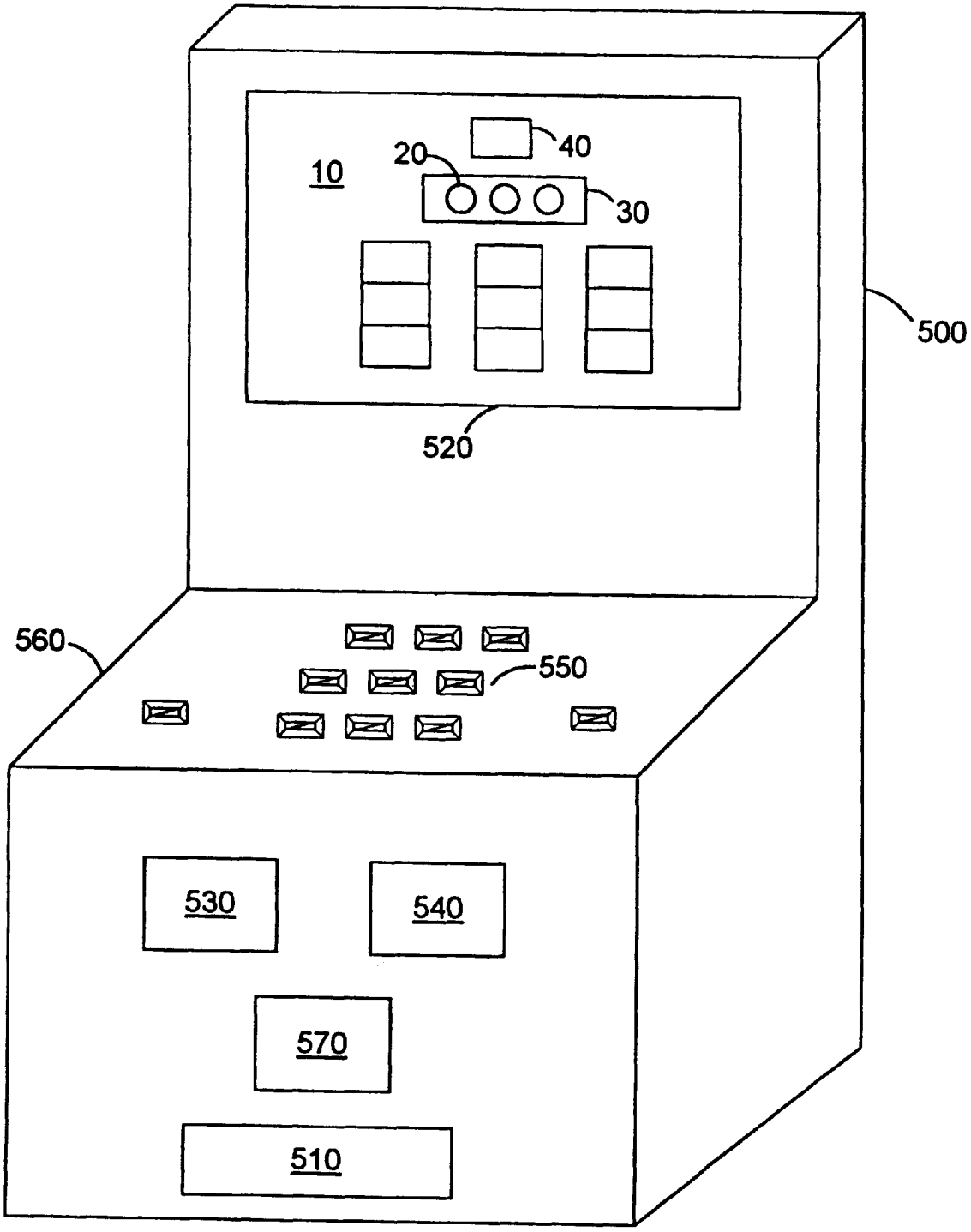
FIG. 6 shows a electronic game machine for playing the game of the present invention.

If a player is playing with one or two game boards, the player wins when all three numbers on any one game board are covered, as shown in FIG. 4. If the player is playing with three game boards, the player wins when any three spaces in a linearly consecutive arrangement, i.e. diagonally across all three boards (e.g., winning combination 420 in FIG. 5), horizontally across all three boards (e.g., winning combination 410 in FIG. 5), or vertically on one board (e.g., winning combination 430 in FIG. 5), are covered. Generally, a player must have covered the last number called by the officiant to be a valid winner.

When a player achieves a winning combination, he or she orally informs the other players and the officiant 60, e.g., by shouting out a designated word such as "Lightning" loud enough to stop play of the game. It is the player's responsibility to indicate his or her winning status to terminate the game. An indication by a player that he or she has won does not finally terminate the game until the officiant 60 has verified that the player is a valid winner, i.e. that the player has only covered those game board spaces containing numbers chosen by the officiant and that a winning arrangement of spaces has been covered.

No game boards may be moved once all game boards have been set up and the game has begun. This rule prevents a player from reorganizing his or her arrangement of game boards, e.g., to obtain a winning diagonal linear arrangement of covered numbers.

The winning player's winnings are determined by the number of chips in the other players' playing chip areas 30 which are not covering game board spaces. Each player keeps all of his or her chips which cover spaces called by the officiant 60. The other chips that the player has set out in his or her playing chip area 30 which do not cover spaces called by the officiant are paid to the player who has won the particular game. In the event there are multiple winners of a particular game, winnings may be divided equally among all of the winners.

In an alternative embodiment, in which the players do not pay an ante to the house at the beginning of each game, the payoff for winning the game is based on a schedule of odds indexed to the number of game pieces chosen before a winning status is determined. As an example, the officiant may choose a predetermined number of game pieces, such as ten game pieces. In this arrangement, there may be no winner, or there may be several winners, after ten numbers are chosen. However, the payout to each winner depends on a wager placed by the player and the number of game pieces chosen to make the player a winner. For example, if the player wins upon the selection of four or fewer game pieces, the payout is 20 to 1. If the player wins upon the selection of from five to ten game pieces, the payout is 1 to 1. If the player is not a winner after ten game pieces have been selected, the player loses the chips not covering board spaces called by the officiant.

The game of the present invention may be implemented as an electronic video or computer game to be played in a casino or other gaming establishment, or even in a remote location, such as a player's home. The game may also be played via an electronic communications network, e.g., the internet. The electronic game includes a processor 510 with a random number generator in a game machine 500. The player views a screen 520 showing the player's playing surface 10 with one, two or three game boards, as determined by the player, playing chip area 30 and chips 20.

The player may be required to purchase game boards and/or chips through gaming machine 500, e.g., by inserting tokens or coins into a coin slot 530 or paper money into a bill collecting device 540. As the officiant randomly chooses numbers, the players cover the spaces on their boards having corresponding numbers, e.g., by pressing buttons 550 on a console 560 of game machine 500 corresponding to the spaces on the boards or by touching the spaces on a touch-sensitive screen 520. Chips are removed from the playing chip area 30 and cover the spaces marked with the called number. Play then continues in the same fashion as described above until a winner is determined. Game machine 500 may, e.g., automatically provide a winning status signal to the officiant to stop play of the game.

Alternatively, an individual player may play against either the processor 510 or against one or more imaginary players controlled by processor 510. The processor has pre-programmed odds of winning and predetermined payout values for winners. The player may be required to purchase chips, e.g., by inserting into coin slot 530 one coin for each chip required. In the embodiment that does not require payment of an ante, the player receives one game board when three coins are inserted, up to three game boards when nine coins are inserted. Numbers are then randomly chosen by processor 510. If the number chosen corresponds to one or more of the spaces on the player's game boards, the processor automatically causes a chip to be deleted from the player's chip area 30 and the space containing the number to be covered. During play of the game, the processor 510 may automatically determine whether the player, or perhaps an imaginary player, is the winner. The game machine 500 may also include a payout dispenser 570 to provide a payout to the player if he or she wins.

Because the game rules are relatively simple, and a game may be completed with as few as three chosen game pieces, games may be played very quickly and may follow each other in rapid succession. For example, as many as two games may be played per minute.

Since games may be played in rapid succession, a player may be required to play with the same group of one, two or three game boards for a series of games. At the end of each series, players may be given the opportunity to purchase additional boards, exchange boards, or return unwanted boards to the house.

Other embodiments are within the scope of the following claims.

What is claimed is:

1. A method of playing a game of chance, comprising providing a player with three game boards, each board having a linear arrangement of three spaces, each space being marked with a game number chosen from a set of game numbers;

aligning the boards adjacent to each other to create a 3×3 array of marked spaces;

randomly selecting a plurality of numbers one at a time from a collection of numbers; and covering each space with a token if the game number marked on the space matches the number selected from the collection of numbers;

wherein the player wins the game if the player covers any three linearly consecutive spaces on adjacent boards of the 3×3 array.

2. The method of claim 1 further comprising purchasing the boards to be played during the game.

3. The method of claim 1 further comprising purchasing the tokens to be played during the game.

4. The method of claim 1 wherein the collection of numbers includes a free number.

5. The method of claim 1 wherein the collection of numbers includes the numbers 1 through 69.

6. The method of claim 1 further comprising paying an ante to participate in the game.

7. The method of claim 1 wherein the numbers are randomly selected by an officiant.

8. The method of claim 7 wherein the officiant is a computerized game controlling device including a random number generator.

9. The method of claim 1 further comprising stopping play of the game when a winning status is indicated.

10. The method of claim 1 further comprising placing 3 tokens for each of the player's boards in a designated area at the beginning of each game.

11. The method of claim 10 further comprising covering the spaces with tokens from the designated area.

12. The new method of claim 11 further comprising giving the tokens remaining in the designated areas of all non-winning players to one or more winning players when play of the game has ended.

13. The method of claim 1 wherein a payout provided to a winning player is based on odds.

14. The method of claim 1 wherein the game is an electronic game.

15. A method of playing an n-number game of chance, n being an integer greater than or equal to 2, the method comprising providing a player with, n game boards each board having a linear arrangement of n spaces, each space being marked with a game number chosen from a set of game numbers;

aligning the boards adjacent to each other to create an n×n array of marked spaces;

randomly selecting a plurality of numbers one at a time from a collection of numbers; and covering each space with a token if the game number marked on the space matches the number selected from the collection of numbers;

wherein the player wins the game if the player covers any n linearly consecutive spaces on adjacent board of the n×n array. n linearly consecutive spaces of the n×n array.

16. The method of claim 15 wherein n is 3.

17. The method of claim 15 wherein n is 4.

18. A game of chance to be played by a player, comprising three game boards, each board having a linear arrangement of three spaces, each space being marked with a game number chosen from a set of game numbers, the player aligning the three boards adjacent to each other to create a 3×3 array of marked spaces;

a plurality of tokens for covering the spaces; and a collection of game pieces marked with numbers to be randomly selected one at a time, the player covering the marked spaces matching the numbers selected with the tokens;

wherein the player wins the game if the player covers any three linearly consecutive spaces on adjacent boards of the 3×3 array.

19. The game of claim 18 wherein the game pieces are balls.

20. The game of claim 18 wherein the game pieces are randomly selected by an officiant.

21. The game of claim 20 wherein the officiant is a computerized game controlling device including a random number generator.

22. An electronic gaming device for playing a game of chance by a player, comprising a screen displaying three game boards, each board having a linear arrangement of three spaces, each space being marked with a game number chosen from a set of game numbers, the three boards arranged as a 3×3 array of marked spaces; and a processor for randomly selecting numbers one at a time and causing the spaces of the player's boards marked with the numbers selected to be covered with a plurality of tokens;

wherein the player wins the game if the player covers any three linearly consecutive spaces on adjacent boards of the 3×3 array.

* * * * *